United States Patent [19]

Schrader et al.

[11] Patent Number: 4,702,523

[45] Date of Patent: Oct. 27, 1987

[54] HARNESS FOR RESTRAINING A CHILD

[76] Inventors: Jennifer R. Schrader, 67 Orchard La.; Harry Geisen, 66 N. Hill Dr., both of New Albany, Ind. 47150

[21] Appl. No.: 927,604

[22] Filed: Nov. 6, 1986

[51] Int. Cl.[4] ..... A47C 31/00; A47D 13/08

[52] U.S. Cl. ..... 297/485; 297/465; 297/467; 297/484

[58] Field of Search ..... 297/464–467, 297/484, 485

[56] References Cited

U.S. PATENT DOCUMENTS

| | | | |
|---|---|---|---|
| 2,414,698 | 1/1947 | Picard | 297/467 X |
| 2,652,183 | 9/1953 | Hlivka | 297/485 X |
| 3,099,486 | 7/1963 | Scott | 297/484 X |
| 4,050,737 | 9/1977 | Jordan | 297/465 |
| 4,235,474 | 11/1980 | Rosenberg | 297/485 X |
| 4,330,152 | 5/1982 | Legan et al. | 297/484 X |
| 4,428,514 | 1/1984 | Elf | 297/465 X |

FOREIGN PATENT DOCUMENTS

| | | | |
|---|---|---|---|
| 649206 | 5/1985 | Switzerland | 297/467 |

*Primary Examiner*—Kenneth J. Dorner
*Assistant Examiner*—Peter R. Brown

[57] ABSTRACT

This invention relates to a safety or restraining harness and more particularly to a sack type garment designed to restrain a child in a high chair, stroller or jumper chair.

The garment consists of a single elongated strip of flexible material with elastic pieces joining the front and back on each side forming a pouch with partially open sides to slip over the back of a chair. The front of pouch extends downwardly and is brought up between the child's legs forming a crotch, then extends upwardly forming the bib section of the sack where two releasably attached straps pass over the child's shoulders to their anchoring points in the front of the pouch. A crotch strap then extends forwardly between the child's legs, loops around the chair seat, and upwardly to a quick release device at the lower extremity of the back pouch section securing the pouch to the chair.

The primary purpose of the invention is to provide a means of restraint for a child that is simply applied in which the torso is kept immobile preventing the child from sliding downwardly, climbing upwardly, or falling forward and still providing free movement of the arms and legs. The unit is multi-functional in that it is adaptable to many various sizes of child containing devices found in the home. The unit's design allows quick removal of the child in emergency situations.

4 Claims, 5 Drawing Figures

HARNESS FOR RESTRAINING A CHILD

BACKGROUND OF THE INVENTION

1. Field of the Invention

This invention relates to a safety device and more particularly to a harness for securing a child in a high chair, stroller or jumper chair by limiting movement of the torso and still allowing comfortable movement of the arms and legs.

2. Description of the Prior Art

Various designs have been suggested to restrain a child or infant in a high chair, straight back chair, and other similar articles of furniture. The intent of these inventions is to keep the child safe yet comfortable; to prevent the child from standing, sliding downwardly, or falling. U.S. Pat. No. 4,235,474, issued 11/25/80, to Linda Rosenberg discloses a restraint for holding a baby in a straight back chair, but the lack of upper body restraint allows the child to climb upwardly to a standing position and eventually falling or overturning the chair. U.S. Pat. No. 3,713,692, issued 01/30/73, to McCracken, et. al., discloses a restraint for preventing lateral movement, but does not prevent the assumption of an upright position wherefrom a child could easily tumble. U.S. Pat. No. 3,245,382, issued 04/12/66, to M. E. Easley, et. al., also restrains lateral movement but does not prevent standing. Thus, these and other prior inventions have not met all of the safety and security requirements for restraining an infant or active child in chairs or the like. Furthermore, some of the prior devices as in U.S. Pat. No. 2,652,183, issued 09/15/53, to Bernice Hlivka, do not lend themselves to rapid disengagement in case the child must be quickly removed in emergencies such as choking.

Our invention overcomes these problems through upper and lower body restraints which secure the child in a seated position. The child can also be removed promptly by the use of quick release devices. The invention's simple design and the use of elastic side strips make it readily adaptable to various sizes of high chairs and the like. It can be made of any washable, durable, flexible material and is inexpensive to manufacture making it affordable for most people.

SUMMARY OF THE INVENTION

The principle object of this invention is to provide a harness for an infant or toddler whereby the child is kept securely and comfortable in a seated position.

Another object of the present invention is to restrain child's torso yet give free movement of arms and legs.

A further object is to provide a harness from which child can be removed promptly in case of emergency such as choking.

Another object is to provide a harness in which a child is conveniently and comfortably placed.

Yet another object of the present invention is to provide a harness that is readily adaptable to various sizes of high chairs and other similar articles.

Still a further object of the invention is to extend the time high chairs and the like are suitable for a child's use.

Another object of this invention is to provide a harness wherein one size fits all.

A further object of this invention is to give reassurance to guardian and increase security for child in baby strollers while in public places since child cannot leave therefrom.

Still another object of this invention is to provide a harness that is inexpensive, simple to use, durable, and can be used through various stages of child's development. The foregoing objects are accomplished by providing a harness with an elasticized pouch slipping over back of high chair or other article, a sack portion in which the child is placed, a set of quick release shoulder straps attached to front of pouch then fastening to sack portion, and an adjustable crotch strap that is then brought between child's legs, looped around the chair seat, and attached with a quick release fastener to the back of pouch.

In addition to the foregoing objects, other objects and benefits will become evident from the following detailed description of the preferred embodiment in combination with the drawings.

DETAILED DESCRIPTION OF THE PREFERRED EMBODIMENT

Figure 4:
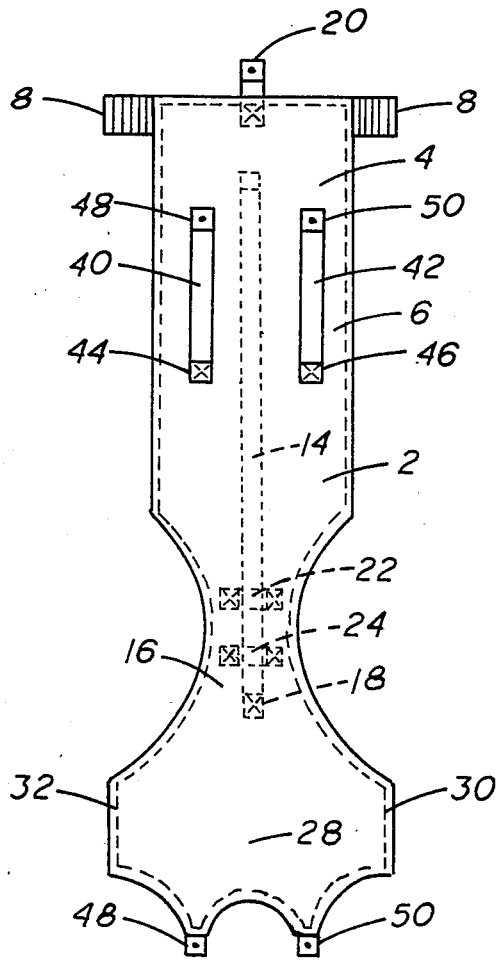
FIG. 4 is a top plan view of the restraining harness in accordance with the invention showing the harness cut from a single sheet of material in a stretched-out flat condition.
Figure 5:
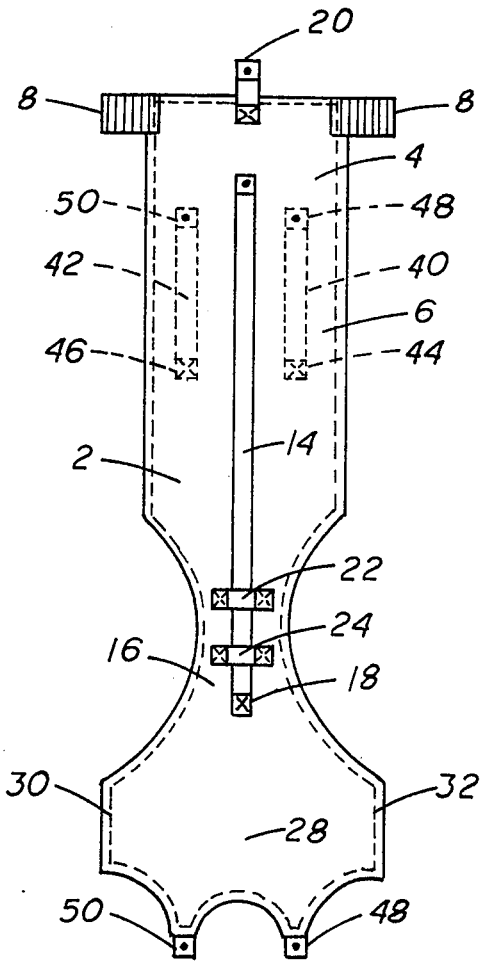
FIG. 5 is a bottom plan view of the harness in FIG. 4.

As clearly illustrated in FIGS. 4 and 5 of the drawing, the device is made from an initially flat, elongated strip of flexible material broadly designated by the numeral 2. The chair engaging section 10 is composed of back portion 4 and front portion 6, both portions 4 and 6 being joined on each side by elastic strips 8 forming an inverted pouch 10 to fit over the back of chair 12, the open sides of the pouch 10 having been joined by elastic strips 8 allow flexibility for adaption to numerous size chair backs. The chair engaging section 10 is firmly secured by elongated strap 14 anchored to crotch section 16 at point 18 and extending forwardly to front edge 34 of chair seat, downwardly to lower edge 36 of chair seat, rearwardly to rear edge 38 of chair seat, then upwardly to the quick release fastener 20 at the lower extremity of back panel 4 of pouch 10. Strap 14 may also be passed through loops 22 or 24 to accommodate various size infants in the harness.

The child containing section 26 is formed by the pouch front 6, the crotch section 16, and the bib panel 28. The pouch front 6 and bib panel 28 are joined by stitching at seams 30 and 32. Flexible straps 40 and 42 anchored at points 44 and 46 in pouch front panel 6 extend forwardly over the child's shoulders to quick release fasteners 48 and 50 at the upper extremity of bib panel 28.

Figure 1:
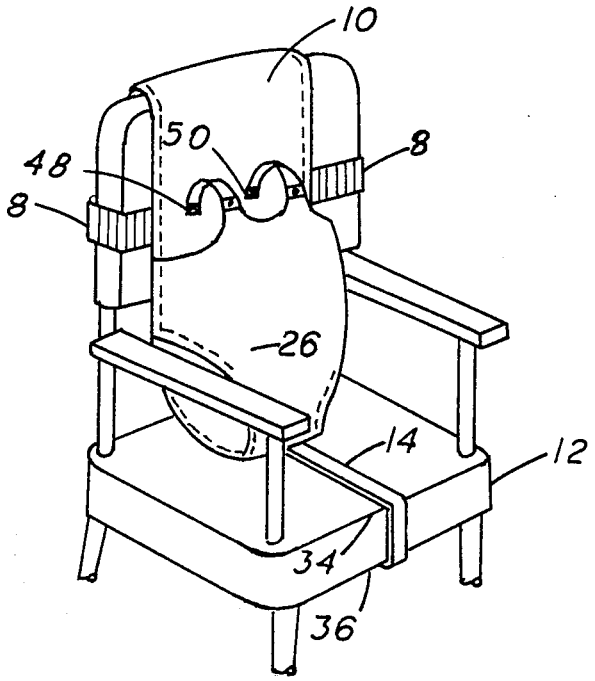
FIG. 1 is a perspective view showing a form of the present invention in position upon a high chair.
Figure 2:
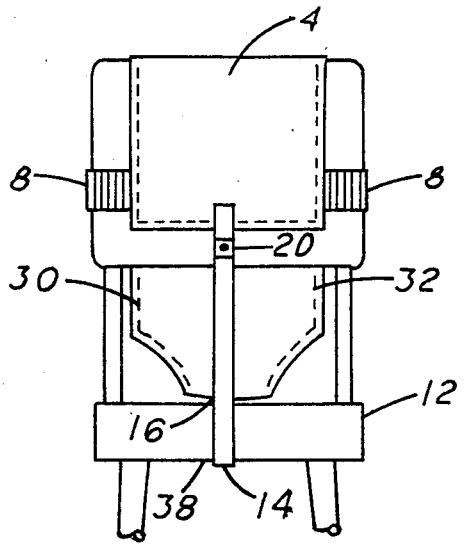
FIG. 2 is a rear elevation view of the harness and chair of FIG. 1.
Figure 3:
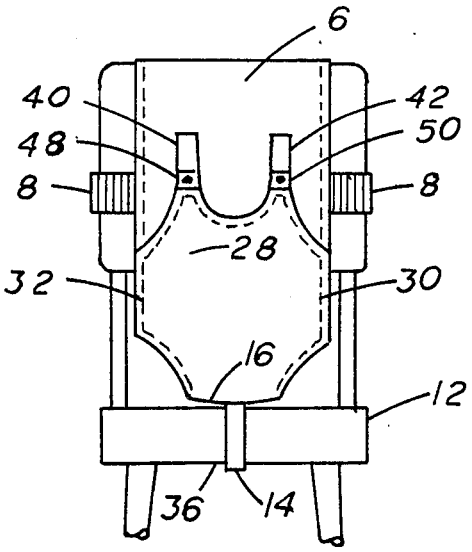
FIG. 3 is a front elevation view of the chair and harness of FIG. 1.

In summary, our invention is quickly and easily attached to chair 12 by slipping self-adjusting pouch section 10 over chair back. The child is put into child containing section 26 and its legs allowed to extend through the openings on either side of crotch 16. The crotch strap 14 is fed through appropriate loop 22 or loop 24, if necessary, looped around chair seat, then extended upwardly to the quickly releasable fastener 20 at the lower extremity of pouch 10 securing harness to chair. As indicated in FIG. 1 and FIG. 3, straps 40 and 42 are passed over the child's shoulders and secured at quick release fasteners 48 and 50 at the upper extremity of bib panel 28 to prevent the child from rising. The child is thus securely restrained in a seated position while its arms and legs are comfortably free to move. Crotch strap 14 and elastic strips 8 anchor the harness in a seated position preventing vertical movement of child. The shoulder straps 40 and 42 prevent child from rising and eventually falling or tipping the chair. The child containing section 26 prevents child from lateral movement and sliding downwardly. In case of emergency, the release of fastener 20 at the lower extremity of pouch 10 permits the removal of the child and the harness instantly.

The foregoing description of the preferred embodiment is not intended to limit the invention to this specific form for numerous changes and modifications readily recognizable by those skilled in the art may be made without departing from the scope of the invention.

What is claimed:

1. A harness for restraining a child in a seated position in a high chair, stroller, or jumper chair; said harness comprising a chair engaging pouch with partially closed sides, said pouch formed by a front panel folded rearwardly over the chair back and joined briefly on each side by connecting means, said front panel of the pouch extending downwardly and narrowing to form a crotch section suitably anchored to the chair by an attached crotch strap passing through either of two horizontal loops of flexible material rearwardly of the crotch strap anchoring point, said crotch strap then passing forwardly to front edge of chair seat, then downwardly and rearwardly encircling said chair seat to a detachably connectible means at said pouch back panel, said loops providing adjustability for varying occupant size; said crotch panel then widening and extending upwardly with lateral flaps on each side connecting with the front panel of the pouch forming the child containing section, the front of said child containing section extending upwardly forming a bib panel with detachably connectible restrictive straps at said bib panel's upper extremities, said restrictive straps passing rearwardly over the child's shoulders to adjacent anchoring points in said pouch front panel.

2. The harness of claim 1 wherein the front and back panels of said pouch section are joined on each side by short sections of elasticized material to form a pouch adaptable to various size high chairs, baby strollers and the like.

3. The harness of claim 1 wherein the lateral flaps of said child containing section are stitched permanently to each side of the pouch section front panel.

4. The harness of claim 1 wherein the terminations of said child containing section are connected by adjustable length straps with quickly releasable connecting means to adjacent anchoring points in pouch front panel.

* * * * *